US005138963A

United States Patent [19]

Eichert

[11] Patent Number: 5,138,963

[45] Date of Patent: Aug. 18, 1992

[54] BOAT ENCLOSURE ASSEMBLY FOR BOAT MAINTENANCE

[75] Inventor: John E. Eichert, Santa Maria, Calif.

[73] Assignee: Eco Safe Systems, A General Partnership of CA, San Diego, Calif.

[21] Appl. No.: 736,429

[22] Filed: Jul. 26, 1991

[51] Int. Cl.[5] ..... B63B 59/00

[52] U.S. Cl. ..... 114/222; 114/45

[58] Field of Search ..... 114/44, 45, 46, 47, 114/48, 222, 258, 259, 260, 263

[56] References Cited

U.S. PATENT DOCUMENTS

| | | | |
|---|---|---|---|
| 3,570,256 | 3/1971 | Thompson | 114/222 |
| 3,752,109 | 8/1973 | Seiple | 114/222 |
| 4,282,822 | 8/1981 | Jackson | 114/222 |
| 4,506,686 | 3/1985 | Bailard et al. | 114/222 |
| 4,510,877 | 4/1985 | Bloxham | 114/45 |

OTHER PUBLICATIONS

Bottom Liner Advertisement.

*Primary Examiner*—Jesus D. Sotelo
*Assistant Examiner*—Stephen P. Avila
*Attorney, Agent, or Firm*—Brown, Martin, Haller & McClain

[57] ABSTRACT

A boat enclosure system for performing boat maintenance work on the water has a U-shaped floating dock forming a three sided enclosure with an opening at one end to enable boats to sail into and out of the enclosure. A bag of flexible, waterproof material is suspended around part of its periphery from the periphery of the dock to form a chamber below the dock, the remainder of the bag periphery extending across the open end of the dock so that it can be dropped into a lowered position allowing clearance below the water for boats to sail in and out of the chamber, and pulled up above the water level when a boat is in the dock to form a closed chamber below the water surface around the hull of the boat. The chamber is connected to a pump and filter unit for circulating water from the chamber through a filter and returning filtered water back to the chamber during maintenance work.

7 Claims, 2 Drawing Sheets

BOAT ENCLOSURE ASSEMBLY FOR BOAT MAINTENANCE

BACKGROUND OF THE INVENTION

The present invention relates generally to a boat enclosure and is particularly concerned with an enclosure assembly which can be used to perform maintenance or boat cleaning on the water, rather than having to move the boat to a dry dock to perform such tasks.

The submerged portion of a boat's hull below the water line typically accumulates dirt and algae growth and must be cleaned and re-painted at regular intervals to ensure that the hull structure does not become irreparably damaged. Additionally, the remainder of the hull as well as the deck, cabins and the like must also be cleaned and re-painted regularly to reduce the effects of weathering. Under current environmental regulations, such regular maintenance work cannot be carried out in open water, since this would result in discharge of undesirable quantities of pollutants into the water. Thus, boats and other craft must often be returned to dry dock for regular maintenance work, at considerable inconvenience and expense.

Plastic liners for enclosing the bottom of boats are known, into which chlorine can be placed for dissolving material accumulating on the hull. However, these do not meet environmental regulations for carrying out maintenance on the water. Also, great care must be taken to ensure that chlorine and dissolved materials do not escape from the liner into the surrounding water, where they will cause environmental pollution problems.

SUMMARY OF THE INVENTION

It is an object of the present invention to provide a new and improved boat enclosure assembly for carrying out boat maintenance on the water.

According to the present invention, a boat enclosure assembly is provided, which comprises a floating, generally U-shaped dock which is open at one end to permit vessels to move in and out of the enclosed area of the dock, and a sheet of flexible, waterproof material suspended around part of its periphery from the periphery of the dock and depending downwardly from the dock to form an enclosure around the bottom of a boat in the dock, the remainder of the sheet's periphery being moveable between a lowered position permitting a boat to sail into the dock and a raised position above the water line. The enclosure is connected via a pump line to a pump and filter assembly for circulating water from within the enclosure to the filter assembly to remove particles from the water and then returning the filtered water back to the enclosure. The pump and filter assembly may be suitably mounted on the floating dock.

This arrangement permits maintenance work to be carried out on a vessel while still on the water, since any debris produced by cleaning or painting will be caught in the enclosure surrounding the vessel and circulated through the filter assembly, where it will be removed by the filter. Preferably, skimmers are also provided to remove any floating debris from the water enclosed within the dock. In a preferred embodiment of the invention, an upper enclosure is provided on the dock for at least partially enclosing the upper parts of a vessel while in the dock. This may be a permanent enclosure with a roof for areas where rain and storms are frequent, or may be a temporary, tent-like or curtained enclosure for warmer, drier climates. This will prevent debris from boat cleaning, for example, from being blown into the water surrounding the floating dock.

With this arrangement, boats and other vessels do not have to be moved to a dry dock whenever any work is to be done on the boat, but minor maintenance such as cleaning above and below the water line and painting above the water line can be done quickly and easily in the floating dock enclosure without taking the boat out of the water. This considerably reduces the expense and inconvenience of boat maintenance.

BRIEF DESCRIPTION OF THE DRAWINGS

The present invention will be better understood from the following detailed description of a preferred embodiment of the invention, taken in conjunction with the accompanying drawings, in which like reference numerals refer to like parts, and in which.

DESCRIPTION OF THE PREFERRED EMBODIMENT

Figure 2:
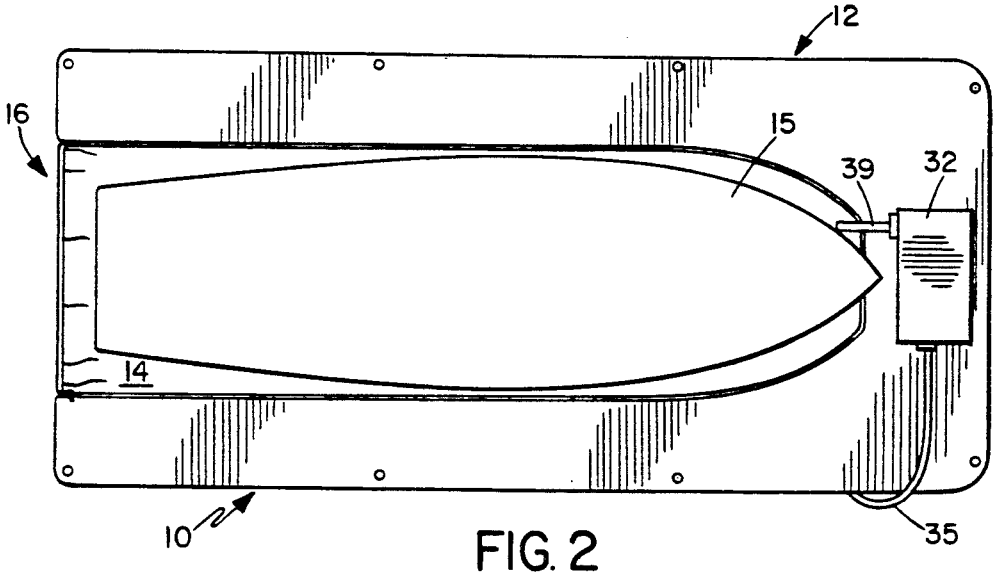
FIG. 2 is a top plan view of the dock.
Figure 3:
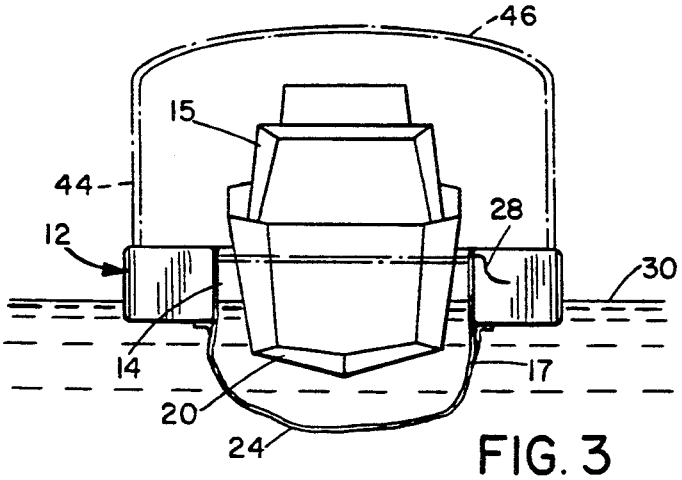
FIG. 3 is an end view of the entry end of the dock.
Figure 5:
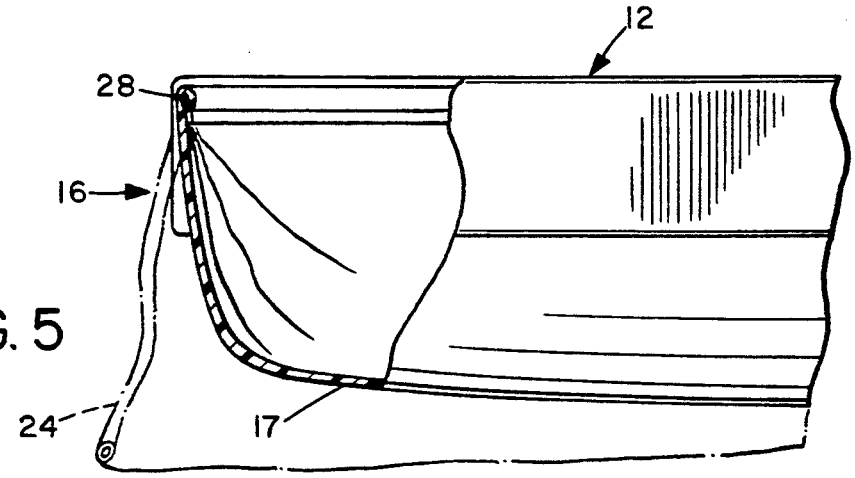
FIG. 5 is an enlarged side elevation view of the entry end, partially cut away to show the open and closed positions of the boat enclosure bag.

The drawings illustrate a boat enclosure assembly 10 according to a preferred embodiment of the present invention for use while performing maintenance work on boats or other vessels. As best illustrated in FIGS. 2 and 3, the assembly basically comprises a generally U-shaped, floating dock 12 defining an area 14 enclosed on three sides of dimensions sufficient for receiving a standard sail or motorboat 15 or equivalent size vessel entering via open end 16, and a sheet or bag 17 of flexible, waterproof material suspended around part of its periphery from the entire periphery of the dock to form an enclosed chamber 18 below the bottom or hull 20 of boat 15 when in the dock. The remainder or free end portion 24 of the periphery of sheet 16 can be released and dropped down into the water to leave an opening to allow a boat to sail in or out of the dock, as best illustrated in FIG. 3. The portion 24 can subsequently be drawn up via drawstring 28 until it is above the water level 30 to complete the chamber surrounding the entire bottom surface of the boat beneath the water level, as illustrated in dotted outline in FIG. 3, and in solid lines in FIG. 5. Lead weights are sewn into periphery of the sheet along portion 24 to ensure that it will drop down into the water when released and not float.

The bag or enclosure sheet 17 is releasably secured to the dock 12 via grommets or similar fasteners, and is preferably of hard wearing material such as neoprene or the like.

Figure 4:
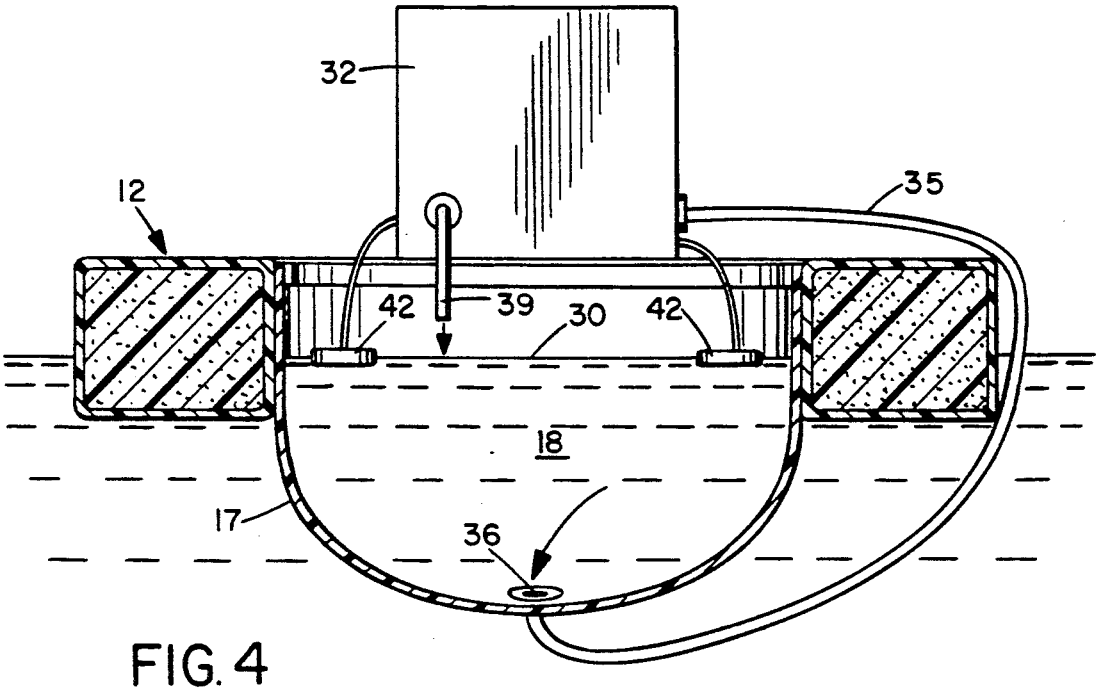
FIG. 4 is an enlarged sectional view taken on line 4—4 of FIG. 1.
Figure 6:
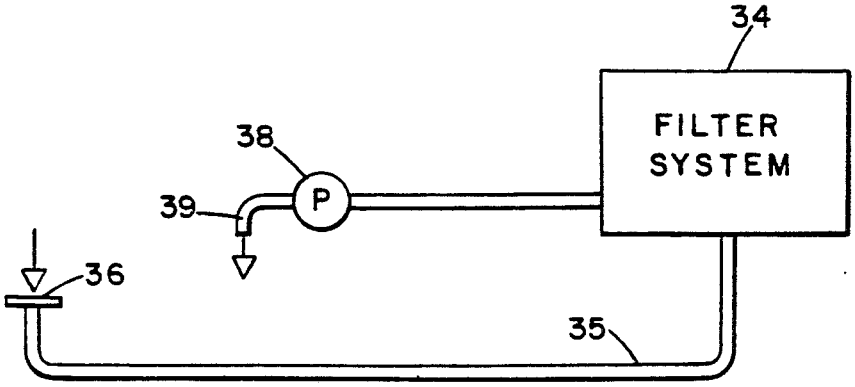
FIG. 6 is a diagram of the filtration system.

A filtration system of the type used in swimming pools is mounted in a suitable housing 32 at one end of the floating dock. As best illustrated in FIGS. 4 and 6, the filtration system basically comprises a filter unit 34 having an inlet connected via flexible tubing 35 to an outlet port 36 provided in the bottom of bag 18, and an outlet connected to a pump 38 for pumping water through the filter unit and back into the bag 17 via outlet pipe 39. Preferably, the inlet tubing 35 is releasably connected to port 36 and may be connected to the port on either side of the sheet 17. This allows the sheet to be reversed periodically to reduce growth on the outermost surface of the sheet. Surface skimmers 42 of the type used in swimming pools to remove lightweight surface debris are provided on the surface of the water within the dock, as illustrated in FIG. 4.

Figure 1:
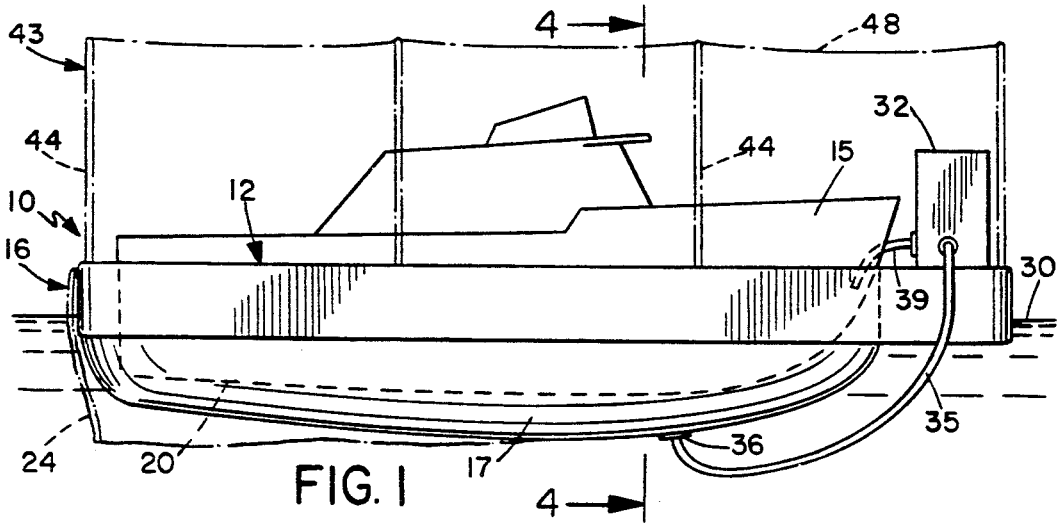
FIG. 1 is a side elevation view of a boat enclosure or floating cleaning dock according to a preferred embodiment of the invention, with a boat in place.

A temporary enclosure or tent-like housing 43 is provided on the dock for enclosing the upper parts of a boat while in the dock, as illustrated in dotted outline in FIGS. 1 and 3. Housing 43 is a temporary housing in the illustrated embodiment, for use in warm, relatively dry climates, but a permanent upper cover or housing may be provided in place of tent housing 43 for wetter climates. The housing 43 in the illustrated embodiment comprises a series of vertical support posts 44 along each leg of the U-shaped dock, with a bendable, removable U-shaped connector tube 46 connecting each aligned pair of posts on opposite legs of the dock. A cover sheet 48 such as a tarpaulin may be thrown across the resultant frame structure to form a temporary enclosure.

This arrangement allows a vessel to be completely enclosed below the water line, and optionally enclosed above the water line as well if necessary. It allows debris-producing maintenance and cleaning work to be carried out without having to transport the boat to a dry dock. When maintenance work such as cleaning or painting is to be done, the boat is simply sailed into the floating dock with the end 24 of the enclosing sheet 16 lowered. The end 24 is then raised using drawstrings 28 to form a chamber 18 completely surrounding the boat below the water line.

The curtains or cover 48 may be extended over the top of the boat if necessary due to bad weather or risk of debris being blown from the upper regions of the boat onto the surrounding water outside the dock. The pump and filter unit will operate continuously while maintenance work is proceeding. While work is being carried out, any debris will fall onto the surface of the water inside the dock. Heavy debris will sink and will be filtered out by circulation through the pump and filter unit 34. Any lightweight debris which floats on the water surface can be removed by skimmers 42. Once work is complete and the water in chamber 18 is completely clean, the end 24 of sheet 16 is lowered and the boat is sailed out of the dock. For sailing boats having high masts, the upper, U-shaped sections 46 of the cover supporting the frame may be removed to allow the boat to sail in and out of the dock freely. This arrangement significantly reduces or eliminates any pollution entering the water as a result of boat maintenance procedures, and avoids the need for moving boats to dry docks every time maintenance is required.

The boat enclosure assembly described above considerably reduces the expense and inconvenience of minor boat maintenance work. Such maintenance work can be carried out without taking the boat out of the water and without risk of causing unacceptable levels of water pollution.

Although a preferred embodiment of the invention has been described above by way of example only, it will be understood by those skilled in the field that modifications may be made to the disclosed embodiment without departing from the scope of the invention, which is defined by the appended claims.

I claim:

1. A boat enclosure assembly, comprising:

a U-shaped floating dock for floating on the water surface forming a three-sided enclosure with an open end for allowing vessels to move into and out of the enclosure;

a bag of flexible, waterproof material suspended around part of its periphery from the periphery of the dock to define a chamber below the dock for enclosing the hull of a vessel in the dock, the remainder of the periphery of the bag extending across the open end of the dock and being moveable vessels to move into the chamber, and a raised position above the water level to close the chamber below the water and completely enclose submerged portions of the hull of a vessel in the dock, the bag dimensions being greater than those of the enclosed vessel hull to form a unitary chamber between the bag and opposing hull surfaces below the water level with the bag surface spaced from the opposing hull surfaces across its entire submerged area, the bag having an outlet port;

a pump and filter assembly mounted on the dock for filtering debris from water pumped through the filter assembly;

an inlet hose connecting the bag outlet port to an inlet of the pump and filter assembly; and an outlet hose connecting the pump and filter assembly to the bag for returning filtered water to the chamber.

2. The assembly as claimed in claim 1, including a housing extending upwardly from the opposite sides of the dock and over the enclosure to cover a boat in the dock.

3. The assembly as claimed in claim 2, wherein the housing comprises an open, generally U-shaped framework and a flexible cover sheet for extending over the framework.

4. The assembly as claimed in claim 1, wherein the bag comprises a sheet of material having opposite first and second faces and is reversible for selectively mounting with the first face innermost or with the second face innermost, the inlet hose having releasable connector means for releasably connecting said inlet hose to said sheet outlet port on either side of said sheet.

5. The assembly as claimed in claim 1, including surface skimmer means for floating on the exposed water surface surrounding a vessel within the enclosure between the vessel and the dock for skimming off floating debris.

6. The assembly as claimed in claim 1, wherein the periphery of the bag extending across the open end of the dock includes a drawstring for drawing the bag above the water level to close the opening, and is weighted to drop down in the water when released.

7. A method of carrying out maintenance on a vessel while in the water, comprising the steps of:

sailing the vessel into a U-shaped floating dock for enclosing the vessel on three sides;

enclosing the portions of the vessel below the water surface in an envelope extending downwardly from the sides of the dock and below the vessel hull to form an enclosed chamber between the surface of the envelope and the submerged surface of the hull;

working on the surface of the vessel;

connecting the chamber below the vessel to a pump and filter assembly to pump water from the chamber through a filter unit to remove debris from the water and returning filtered water to the chamber; and releasing at least one end of the envelope when work on the vessel is completed to provide an opening allowing the vessel to sail out of the dock.

* * * * *

UNITED STATES PATENT AND TRADEMARK OFFICE

CERTIFICATE OF CORRECTION

PATENT NO. : 5,138,963

DATED : August 18, 1992

INVENTOR(S) : John E. Eichert

It is certified that error appears in the above-identified patent and that said Letters Patent is hereby corrected as shown below:

Column 4, claim 1, line 9, after "able" insert

--between a lowered position forming an opening for allowing--

Signed and Sealed this

Ninth Day of November, 1993

Bruce Lehman

*Attest:*

BRUCE LEHMAN

*Attesting Officer*

*Commissioner of Patents and Trademarks*